US010706705B2

(12) United States Patent
Holt

(10) Patent No.: US 10,706,705 B2
(45) Date of Patent: Jul. 7, 2020

(54) BABY CLOUD

(71) Applicant: Paula Holt, Benecia, CA (US)

(72) Inventor: Paula Holt, Benecia, CA (US)

( * ) Notice: Subject to any disclaimer, the term of this patent is extended or adjusted under 35 U.S.C. 154(b) by 162 days.

(21) Appl. No.: 16/150,998

(22) Filed: Oct. 3, 2018

(65) Prior Publication Data

US 2020/0111339 A1 Apr. 9, 2020

(51) Int. Cl.
*G08B 21/02* (2006.01)

(52) U.S. Cl.
CPC ..... *G08B 21/0291* (2013.01); *G08B 21/028* (2013.01)

(58) Field of Classification Search
None
See application file for complete search history.

(56) References Cited

U.S. PATENT DOCUMENTS

2011/0230115 A1* 9/2011 Wang ..... A63H 33/006 446/227
2014/0118548 A1* 5/2014 Veneziano ..... H04N 5/23206 348/148
2015/0288877 A1* 10/2015 Glazer ..... H04N 5/2251 348/77
2016/0015277 A1* 1/2016 Dumoulin ..... H04N 7/185 600/301
2017/0055877 A1* 3/2017 Niemeyer ..... A61B 5/0077
2017/0208225 A1* 7/2017 Rice ..... H04N 5/2252
2018/0053393 A1* 2/2018 White ..... A61B 5/0077
2019/0208363 A1* 7/2019 Shapiro ..... G16H 50/30
2019/0272724 A1* 9/2019 Greene ..... G08B 25/08
2019/0279481 A1* 9/2019 Silberschatz ..... A61B 5/0077

* cited by examiner

*Primary Examiner* — Mazda Sabouri
(74) *Attorney, Agent, or Firm* — Foundation Patents, LLP; Richard Bennett Salles

(57) ABSTRACT

A child monitor device system which collects visual and audio data at a first location [and also transmits visual and auditory signals at this first location], ideally a baby's crib, then provides access to [and displays] this data at a second location (e.g. a touchscreen monitor-&-speaker-system on the dashboard of a parent's vehicle) via specially-tailored systems and device(s) which additionally alert the parent to hazards, and wherein the monitor device system may be detached and moved to a third location (e.g. a car's back seat) so the parent can continuously monitor [and entertain] the child throughout the day. The device itself is portable via removable couplings.

7 Claims, 13 Drawing Sheets

BABY CLOUD

TECHNICAL FIELD

Various embodiments relate generally to child safety monitoring and entertainment.

BACKGROUND

Baby monitors are remote communication systems. Some baby monitors may provide audio or images from a baby's location to a monitor location remote from the baby. For example, a baby monitor located in a baby's crib may send video or audio of a monitored baby to a caregiver's mobile device via wireless communication. In various scenarios, a caregiver receiving video or audio of a sleeping baby via a mobile device may be able to detect exceptional conditions that may affect the baby. Some exceptional conditions affecting a baby may be dangerous to the baby, such as, for example, respiratory arrest, choking, or environmental conditions such as fire or flood. Users of baby monitors include parents, child caretakers, day care staff, and hospital personnel, who may be responsible for a baby's safety or security.

Some users may employ a baby monitor to monitor a baby's status. For example, a caregiver may determine if a baby is sleeping or awake based on viewing a video or audio baby monitor feed. In some examples, a user may prevent an exceptional condition detrimental to the baby, based on data received from a baby monitor. Some exceptional conditions such as silent choking impact many babies each year, and such a condition may be mitigated if detected soon enough. In an illustrative example, a caregiver monitoring a baby monitor's audio or video feed may be able to respond soon enough based on using the audio or video feed to detect the baby's silent choking.

In some examples, baby monitors may be configured to provide audio or video to the baby's location from a monitoring location. Some baby monitors may be configured to permit a remote caregiver to direct the baby monitor to provide sound helping to calm the baby. For example, a caregiver may choose from a mobile device menu soothing music to be played by the baby monitor. In various scenarios, a caregiver may speak or sing to the monitored baby through their mobile device communicatively coupled with a baby monitor, permitting the baby to be comforted at a remote location by a familiar voice. Some baby monitors may be cumbersome to transport and configure at a new monitoring location. A user employing a baby monitor at many locations may be required to reconfigure the baby monitor power, network connections, or operating parameters, in each location where the baby monitor is used.

SUMMARY

Apparatus and associated methods relate to a child monitor device configured to monitor a child as a function of image and audio data captured at a first location, provide access at a second location to image and audio data of the child captured at a third location, and automatically send alerts generated in response to exceptional child conditions detected as a function of image and audio data captured at the third location. In an illustrative example, the first location may be a baby's crib. The second location may be, for example, a car front seat, and the third location may be the car rear seat. In some examples, the exceptional child conditions may include an unsafe condition. Various examples may advantageously provide operable portability of the child monitor device between the first and third locations, based on removably securable couplings configured in the child monitor device and the various locations.

Various embodiments may achieve one or more advantages. For example, some embodiments may improve a user's ease of access to baby monitoring in multiple locations. This facilitation may be a result of reducing the user's effort moving the baby monitor from a crib at the user's home, to the user's car. In some embodiments, moving the baby monitor between a baby's crib and the user's car may be simplified. Such simplified baby monitor portability may be a result of removably securing the baby monitor with a connector adapted to automatically configure the baby monitor power and mechanical connections as the baby monitor is moved between locations. Various implementations may increase the user's safety when monitoring a baby while driving. This facilitation may be a result of providing a video feed of a monitored baby in a rear-facing car rear seat to a display visible to a front-facing driver. In some embodiments, music or sound to comfort or entertain a baby may be automatically selected and played in response to a user's voice command or the baby's crying or distress sounds. Such automatic baby monitoring responses may reduce a user's exposure to fatigue from monitoring and entertaining a baby.

Some embodiments may increase the number of caregivers available for a given baby at a given time. This facilitation may be a result of monitoring a baby as a function of image and audio data captured at a first location and providing access at a second location to image and audio data of the baby captured at a third location. In an illustrative example, multiple caregivers at different locations could monitor the baby at various times. Some embodiments may automatically alert caregivers at a monitoring location in response to detected dangerous conditions at a monitored location. Such automatic dangerous condition alerts may be a result of a cloud-based virtual assistant configured to automatically trigger alerts based on image or audio data captured from a monitored location. In an illustrative example, a cloud-based virtual assistant may be configured to generate alerts triggered as functions of baby movements or breathing patterns determined anomalous based on captured audio or video of the monitored baby and predetermined thresholds.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
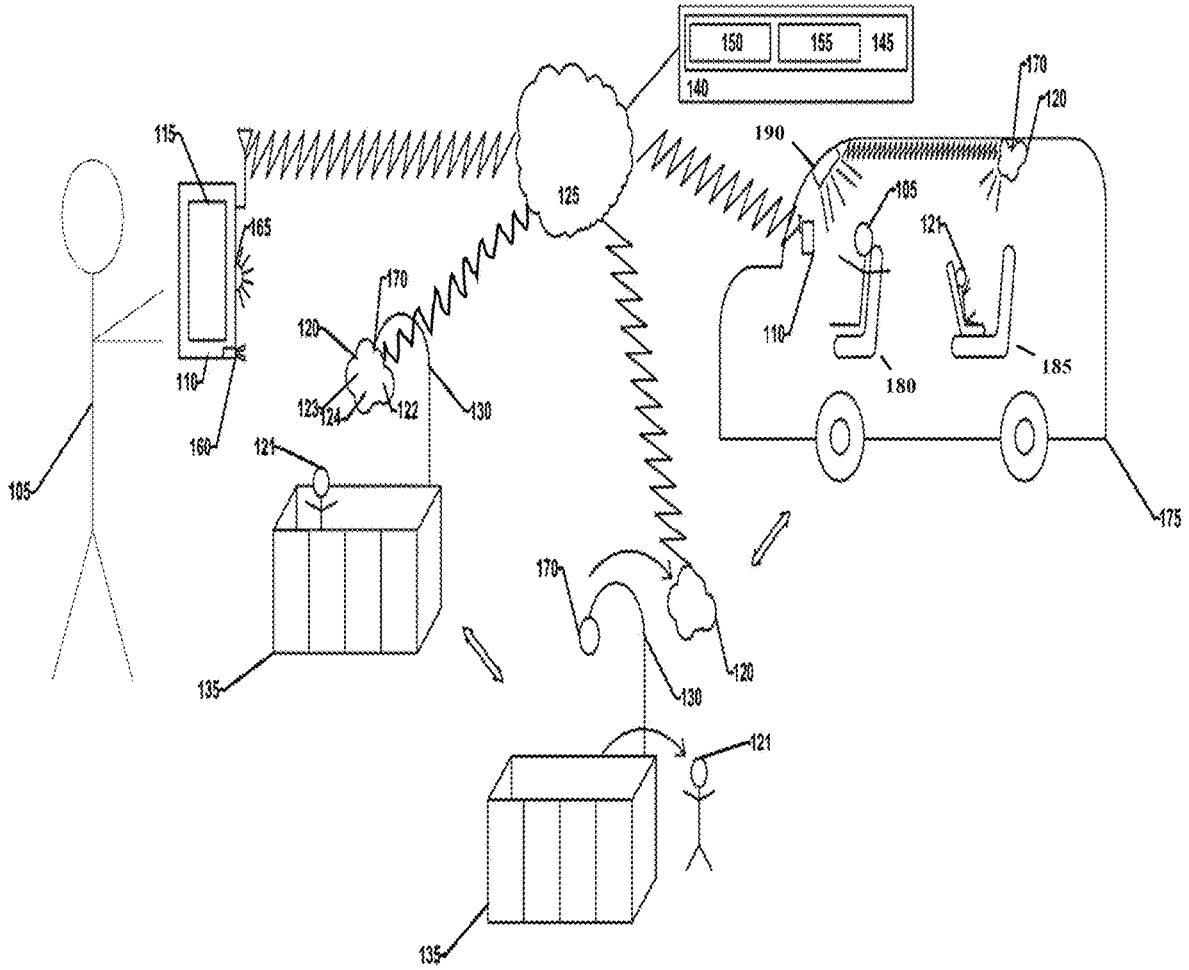
FIG. 1 depicts an exemplary child caregiver using an exemplary child monitor device configured to monitor a child as a function of image and audio data captured at a first location, provide access at a second location to image and audio data of the child captured at a third location, and automatically send alerts generated in response to exceptional child conditions detected as a function of image and audio data captured at the third location.

FIG. 1 depicts an exemplary child caregiver (e.g. a mother) using the child monitor device herein configured to monitor a child as a function of image and audio data captured at a first location, then to provide access (at a second location) to image data and audio data [of the child herein captured] at a third location, and automatically send alerts generated in response to exceptional child conditions detected as a function of said captured-data [captured at the third location]. In FIG. 1, the child caregiver 105 employs the mobile device 110 hosting the mobile app 115 to configure the exemplary child monitor device 120 to monitor the child 121. In the depicted embodiment, the child monitor device 120 includes microphone 122. In the illustrated embodiment, the child monitor device 120 includes camera 123. In the depicted embodiment, the child monitor device 120 includes audio speaker 124. In the depicted embodiment, the child caregiver 105 uses the mobile device 110 to configure the child monitor device 120 via the network cloud 125. In the illustrated embodiment, the child monitor device 120 is removably secured by the monitor device 120 stand 130 at the first location 135. In an illustrative example, the first location is a baby crib.

In the depicted embodiment, the child monitor device 120 monitors and entertains the child 121 based on image and audio data captured by the child monitor device 120 at the first location 135. In the illustrated embodiment, the cloud server 140 hosts child profile data 145. In the depicted embodiment, the child profile data 145 includes child audio data 150. In the illustrated embodiment, the child profile data 145 includes child image data 155. In the depicted embodiment, the mobile device 110 includes microphone 160. In the illustrated embodiment, the mobile device 110 includes camera 165. In the illustrated embodiment, the child monitor device 120 stand 130 includes monitor device 120 connector 170 securing the child monitor device 120 at the first location 135.

In the depicted embodiment, the child caregiver 105 moves the child 121 and the child monitor device 120 to the car 175. In the illustrated example, the car 175 includes a front seat at the second location 180 and a rear seat at the third location 185. In the depicted example, the child 121 is secured in a rear-facing child safety seat installed at the third location 185. In the depicted embodiment, the child caregiver 105 uses the mobile device 110 and the monitor device 190 from the second location 180 to monitor the rear-facing child 121. In the illustrated example, the child monitor device 120 monitors the child 121 as a function of image and audio data captured at the first location 135, provides access at the second location 180 to image and audio data of the child 121 captured at the third location 185, and automatically sends alerts generated in response to exceptional child conditions detected as a function of image and audio data captured at the third location 185.

Figure 2:
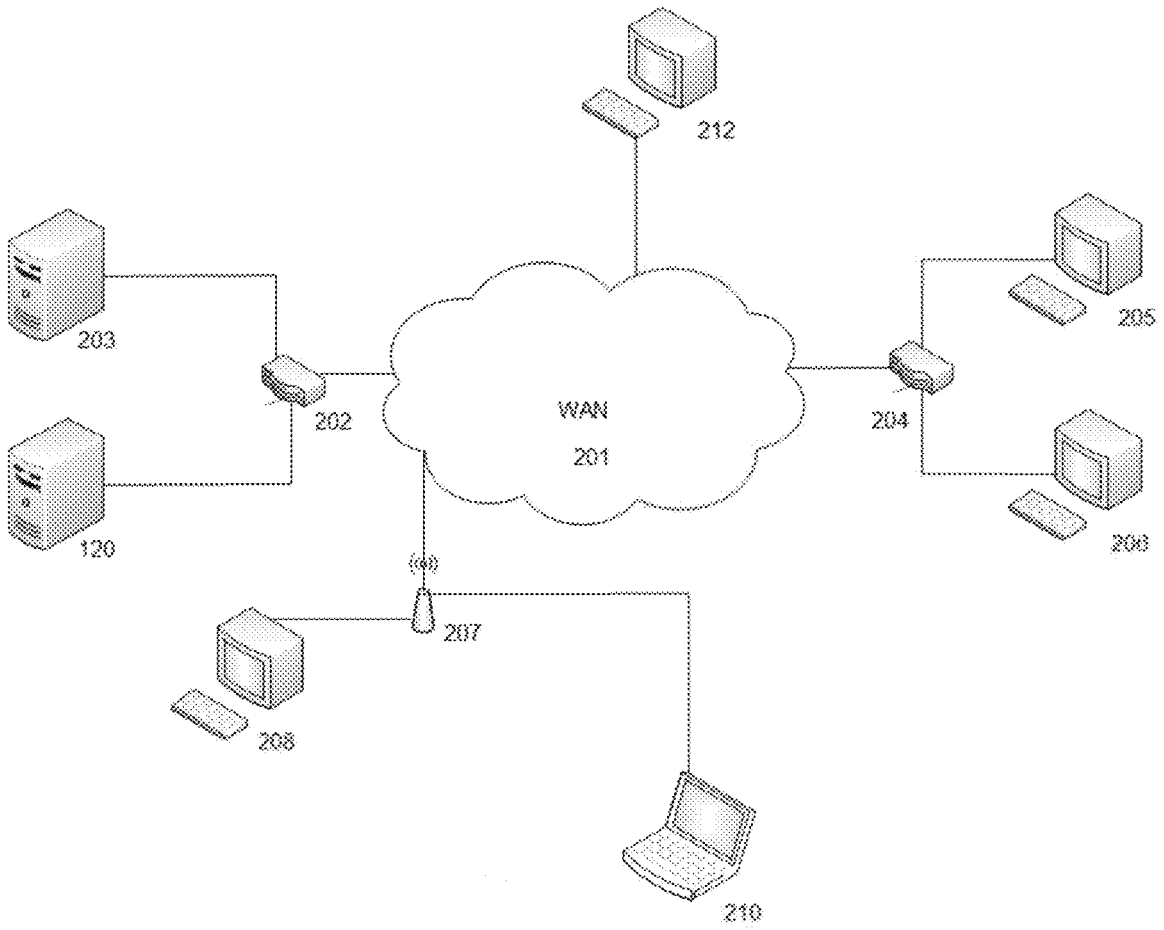
FIG. 2 depicts a schematic view of an exemplary child monitor network including an exemplary child monitor device configured to monitor a child as a function of image and audio data captured at a first location, provide access at a second location to image and audio data of the child captured at a third location, and automatically send alerts generated in response to exceptional child conditions detected as a function of image and audio data captured at the third location.

FIG. 2 is a schematic view of a child monitor network including a child monitor device configured to monitor the child as a function of image and audio data captured at a first location, provide access at a second location to image and audio data of the child captured at a third location, and automatically send alerts generated in response to exceptional child conditions detected as a function of image and audio data captured at the third location. In FIG. 2, according to an exemplary embodiment of the present disclosure, data may be transferred to the system, stored by the system and/or transferred by the system to users of the system across local area networks (LANs) or wide area networks (WANs). In accordance with the previous embodiment, the system may be comprised of numerous servers, data mining hardware, computing devices, or any combination thereof, communicatively connected across one or more LANs and/or WANs. One of ordinary skill in the art would appreciate that there are numerous manners in which the system could be configured, and embodiments of the present disclosure are contemplated for use with any configuration.

Referring to FIG. 2, a schematic overview of a system in accordance with an embodiment of the present disclosure is shown. In depicted embodiment, an exemplary system includes the exemplary computing device 120 adapted to monitor a child as a function of image and audio data captured at a first location, provide access at a second location to image and audio data of the child captured at a third location, and automatically send alerts generated in response to exceptional child conditions detected as a function of image and audio data captured at the third location. In the illustrated embodiment, the device 120 is communicatively and operably coupled with the WAN 201 (e.g., the Internet) to send, retrieve, or manipulate information in storage devices, servers, and network components, and exchange information with various other systems and devices via the WAN 201. In the depicted example, the illustrative system is comprised of one or more application servers 203 for electronically storing information used by the system. Applications in the server 203 may retrieve and manipulate information in storage devices and exchange information through a WAN 201 (e.g., the Internet). Applications in server 203 may also be used to manipulate information stored remotely and process and analyze data stored remotely across a WAN 201 (e.g., the Internet). According to an exemplary embodiment, as shown in FIG. 2, exchange of information through the WAN 201 or other network may occur through one or more high speed connections. In some cases, high speed connections may be over-the-air (OTA), passed through networked systems, directly connected to one or more WANs 201 or directed through one or more routers 202. In various implementations, router(s) 202 may be optional, and other embodiments in accordance with the present disclosure may or may not utilize one or more routers 202. One of ordinary skill in the art would appreciate that there are numerous ways server 203 may connect to WAN 201 for the exchange of information, and embodiments of the present disclosure are contemplated for use with any method for connecting to networks for the purpose of exchanging information. Further, while this application refers to high speed connections, embodiments of the present disclosure may be utilized with connections of any speed. Components or modules of the system may connect to device 120 or server 203 via WAN 201 or other network in numerous ways.

For instance, a component or module may connect to the system i) through a computing device 212 directly connected to the WAN 201, ii) through a computing device 205, 206 connected to the WAN 201 through a routing device 204, or iii) through a computing device 208, 210 connected to a wireless access point 207. One of ordinary skill in the art will appreciate that there are numerous ways that a component or module may connect to device 120 or server 203 via WAN 201 or other network, and embodiments of the present disclosure are contemplated for use with any method for connecting to device 120 or server 203 via WAN 201 or other network. Furthermore, device 120 or server 203 could be comprised of a personal computing device, such as a smartphone, acting as a host for other computing devices to connect to. The communications means of the system may be any circuitry or other means for communicating data over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any communications means.

Figure 3:
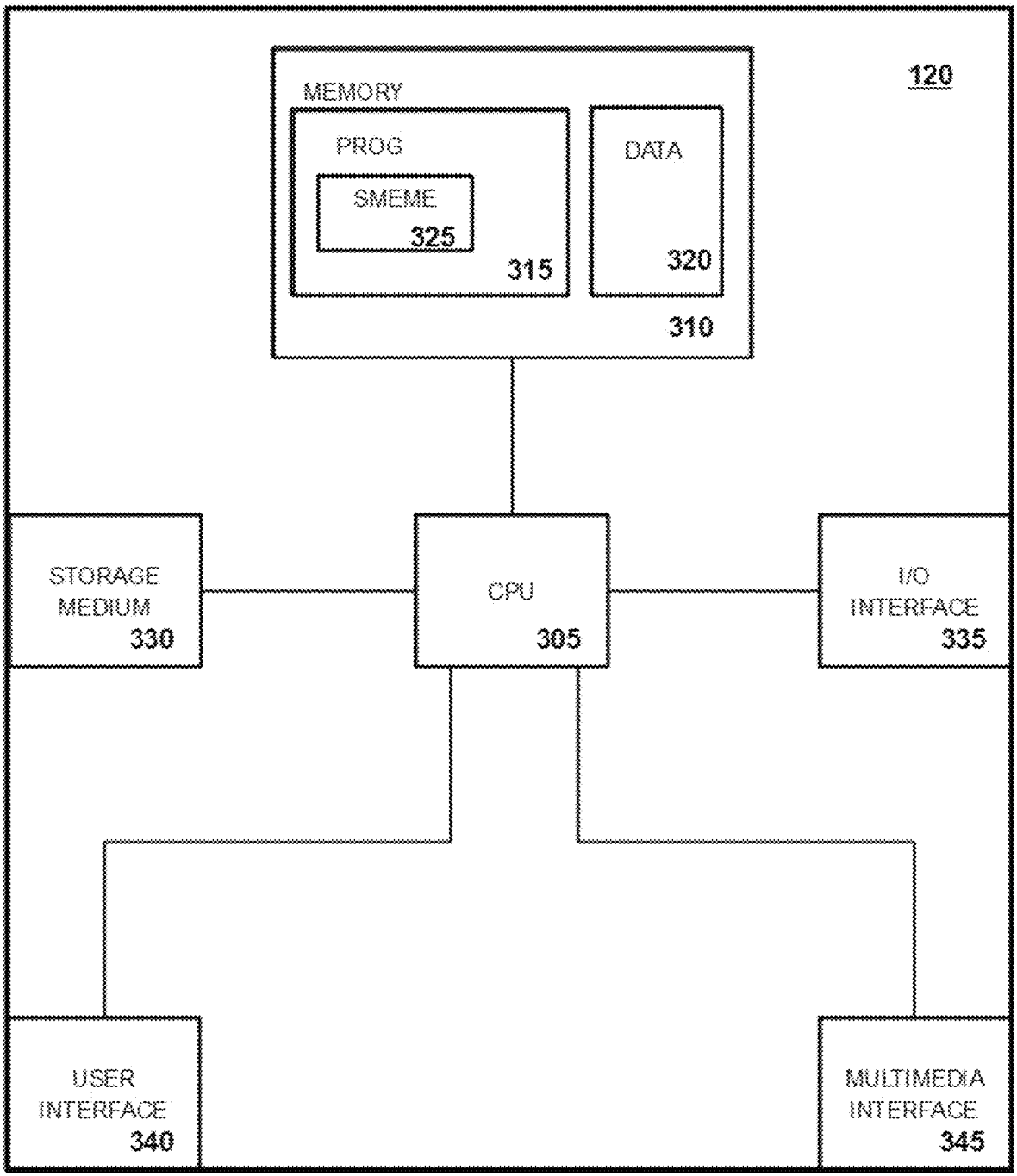
FIG. 3 depicts a structural view of an exemplary computing device configured to monitor a child as a function of image and audio data captured at a first location, provide access at a second location to image and audio data of the child captured at a third location, and automatically send alerts generated in response to exceptional child conditions detected as a function of image and audio data captured at the third location.

FIG. 3 depicts a structural view of an exemplary computing device configured to monitor a child as a function of image and audio data captured at a first location, provide access at a second location to image and audio data of the child captured at a third location, and automatically send alerts generated in response to exceptional child conditions detected as a function of image and audio data captured at the third location. In FIG. 3, the block diagram of the exemplary child monitor device 120 includes processor 305 and memory 310. The processor 305 is in electrical communication with the memory 310. The depicted memory 310 includes program memory 315 and data memory 320. The depicted program memory 315 includes processor-executable program instructions implementing the SMEME (Safety Monitoring and Entertainment Management Engine) 325. In some embodiments, the illustrated program memory 315 may include processor-executable program instructions configured to implement an OS (Operating System). In various embodiments, the OS may include processor executable program instructions configured to implement various operations when executed by the processor 305. In some embodiments, the OS may be omitted. In some embodiments, the illustrated program memory 315 may include processor-executable program instructions configured to implement various Application Software. In various embodiments, the Application Software may include processor executable program instructions configured to implement various operations when executed by the processor 305. In some embodiments, the Application Software may be omitted. In the depicted embodiment, the processor 305 is communicatively and operably coupled with the storage medium 330.

In the depicted embodiment, the processor 305 is communicatively and operably coupled with the user interface 340. In the depicted embodiment, the processor 305 is communicatively and operably coupled with the I/O (Input/Output) module 335. In the depicted embodiment, the I/O module 335 includes a network interface. In various implementations, the network interface may be a wireless network interface. In some designs, the network interface may be a Wi-Fi interface. In some embodiments, the network interface may be a Bluetooth interface. In an illustrative example, the child monitor device 120 may include more than one network interface. In some designs, the network interface may be a wireline interface. In some designs, the network interface may be omitted. In various implementations, the user interface 340 may be adapted to receive input from a user or send output to a user. In some embodiments, the user interface 340 may be adapted to an input-only or output-only user interface mode. In various implementations, the user interface 340 may include an imaging display. In some embodiments, the user interface 340 may include an audio interface. In some designs, the audio interface may include an audio input. In various designs, the audio interface may include an audio output. In some implementations, the user interface 340 may be touch-sensitive. In some designs, the child monitor device 120 may include an accelerometer operably coupled with the processor 305. In various embodiments, the child monitor device 120 may include a GPS module operably coupled with the processor 305. In an illustrative example, the child monitor device 120 may include a magnetometer operably coupled with the processor 305. In some embodiments, some or all parts of an exemplary child monitor device 120 system may be included within a client device, such that the functionalities could operate in a distributed manner. In some embodiments, the user interface 340 may include an input sensor array. In various implementations, the input sensor array may include one or more imaging sensor. In various designs, the input sensor array may include one or more audio transducer. In some implementations, the input sensor array may include a radio-frequency detector.

In an illustrative example, the input sensor array may include an ultrasonic audio transducer. In some embodiments, the input sensor array may include image sensing subsystems or modules configurable by the processor 305 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In various implementations, the depicted memory 310 may contain processor executable program instruction modules configurable by the processor 305 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In some embodiments, the input sensor array may include audio sensing subsystems or modules configurable by the processor 305 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In various implementations, the depicted memory 310 may contain processor executable program instruction modules configurable by the processor 305 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In the depicted embodiment, the processor 305 is communicatively and operably coupled with the multimedia interface 345.

In the illustrated embodiment, the multimedia interface 345 includes interfaces adapted to input and output of audio, video, and image data. In some embodiments, the multimedia interface 345 may include one or more still image camera or video camera. In various designs, the multimedia interface 345 may include one or more microphone. In some implementations, the multimedia interface 345 may include a wireless communication means configured to operably and communicatively couple the multimedia interface 345 with a multimedia data source or sink external to the child monitor device 120. In various designs, the multimedia interface 345 may include interfaces adapted to send, receive, or process encoded audio or video. In various embodiments, the multimedia interface 345 may include one or more video, image, or audio encoder. In various designs, the multimedia interface 345 may include one or more video, image, or audio decoder. In various implementations, the multimedia interface 345 may include interfaces adapted to send, receive, or process one or more multimedia stream. In various implementations, the multimedia interface 345 may include a GPU. In some embodiments, the multimedia interface 345 may be omitted. Useful examples of the illustrated child monitor device 120 include, but are not limited to, personal computers, servers, tablet PCs, smartphones, or other computing devices. In some embodiments, multiple child monitor device 120 devices may be operably linked to form a computer network in a manner as to distribute and share one or more resources, such as clustered computing devices and server banks/farms. Various examples of such general-purpose multi-unit computer networks suitable for embodiments of the disclosure, their typical configuration and many standardized communication links are well known to one skilled in the art, as explained in more detail in the foregoing FIG. 2 description. In some embodiments, an exemplary child monitor device 120 design may be realized in a distributed implementation.

In an illustrative example, some child monitor device 120 designs may be partitioned between a client device, such as, for example, a phone, and, a more powerful server system, such as server 203, depicted in FIG. 2. In various designs, a child monitor device 120 partition hosted on a PC or mobile device may choose to delegate some parts of computation, such as, for example, machine learning or deep learning, to a child monitor device 120 host server. In some embodiments, a client device child monitor device 120 partition may delegate computation-intensive tasks to a child monitor device 120 host server to take advantage of a more powerful processor, or to offload excess work. In an illustrative example, some mobile devices may be configured with a mobile chip including an engine adapted to implement specialized processing, such as, for example, neural networks, machine learning, artificial intelligence, image recognition, audio processing, or digital signal processing. In some embodiments, such an engine adapted to specialized processing may have sufficient processing power to implement some child monitor device 120 features. However, in some embodiments, an exemplary child monitor device 120 may be configured to operate on device with less processing power, such as, for example, various gaming consoles or phones, which may not have sufficient processor power, or a suitable CPU architecture, to adequately support child monitor device 120. Various embodiment child monitor device 120 designs configured to operate on a such a device with reduced processor power may work in conjunction with a more powerful child monitor device 120 server system.

Figure 4:
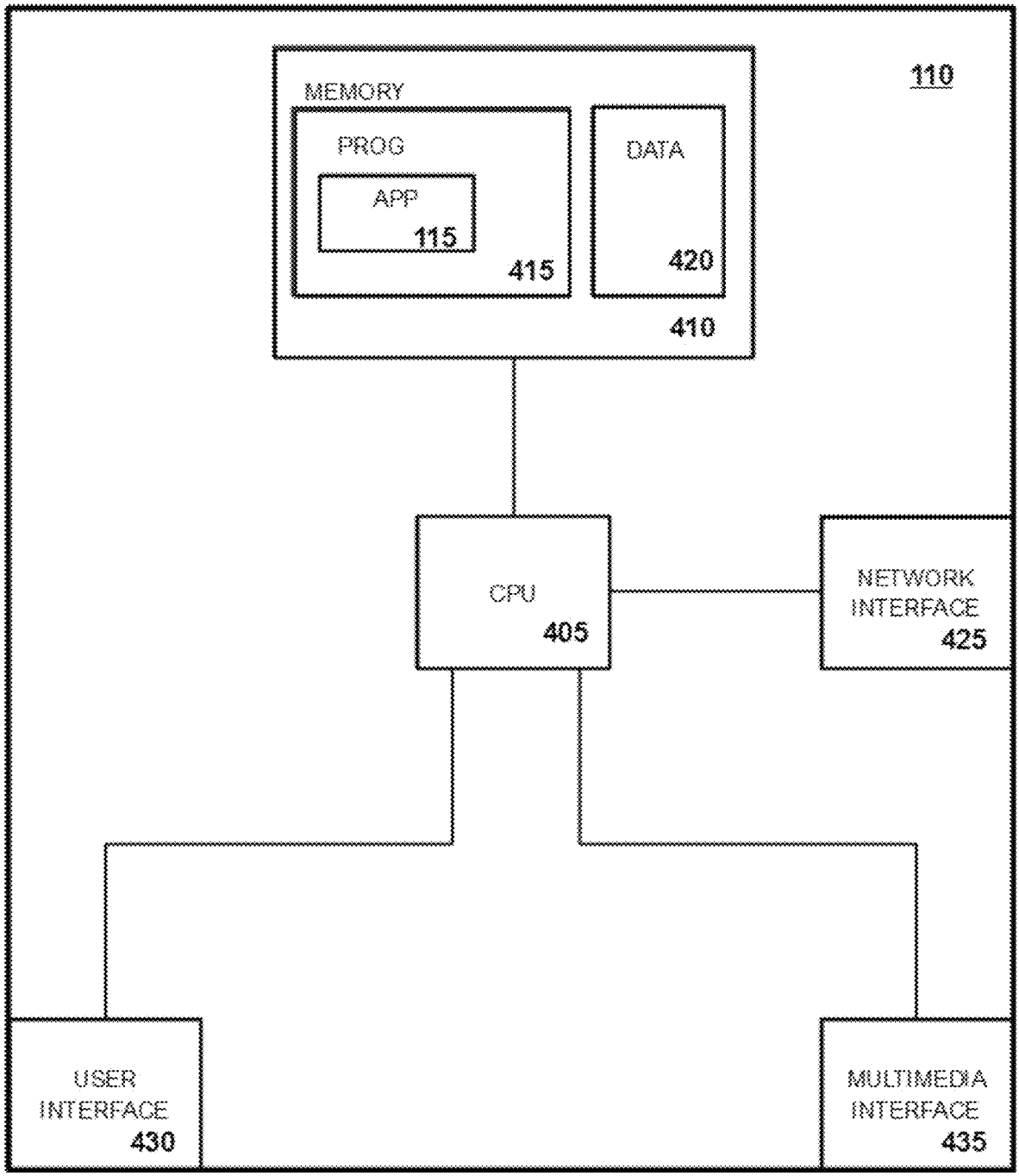
FIG. 4 depicts a structural view of an exemplary mobile device adapted to configure an exemplary child monitor device to monitor a child as a function of image and audio data captured at a first location, provide access at a second location to image and audio data of the child captured at a third location, and automatically send alerts generated in response to exceptional child conditions detected as a function of image and audio data captured at the third location.

FIG. 4 depicts a structural view of the mobile device configured to monitor a child as a function of image and audio data captured at a first location, provide access at a second location to image and audio data of the child captured at a third location, and automatically send alerts generated in response to exceptional child conditions detected as a function of image and audio data captured at the third location.

In FIG. 4, the block diagram of the exemplary mobile device 110 includes processor 405 and memory 410. The processor 405 is in electrical communication with the memory 410. The depicted memory 410 includes program memory 415 and data memory 420. The depicted program memory 415 includes processor-executable program instructions implementing the mobile app 115. In some embodiments, the illustrated program memory 415 may include processor-executable program instructions configured to implement an OS (Operating System). In various embodiments, the OS may include processor executable program instructions configured to implement various operations when executed by the processor 405. In some embodiments, the OS may be omitted. In some embodiments, the illustrated program memory 415 may include processor-executable program instructions configured to implement various Application Software.

In various embodiments, the Application Software may include processor executable program instructions configured to implement various operations when executed by the processor 405. In some embodiments, the Application Software may be omitted. In the depicted embodiment, the processor 405 is communicatively and operably coupled with the network interface 425. In various implementations, the network interface may be a wireless network interface. In some designs, the network interface may be a Wi-Fi interface. In some embodiments, the network interface may be a Bluetooth interface. In an illustrative example, the mobile device 110 may include more than one network interface. In some designs, the network interface may be a wireline interface. In some designs, the network interface may be omitted. In the depicted embodiment, the processor 405 is communicatively and operably coupled with the user interface 430. In various implementations, the user interface 430 may be adapted to receive input from a user or send output to a user. In some embodiments, the user interface 430 may be adapted to an input-only or output-only user interface mode.

In various implementations, the user interface 430 may include an imaging display. In some embodiments, the user interface 430 may include an audio interface. In some designs, the audio interface may include an audio input. In various designs, the audio interface may include an audio output. In some implementations, the user interface 430 may be touch-sensitive. In some designs, the mobile device 110 may include an accelerometer operably coupled with the processor 405. In various embodiments, the mobile device 110 may include a GPS module operably coupled with the processor 405. In an illustrative example, the mobile device 110 may include a magnetometer operably coupled with the processor 405. In some embodiments, some or all parts of an exemplary mobile device 110 system may be included within a client device, such that the functionalities could operate in a distributed manner. In some embodiments, the user interface 430 may include an input sensor array. The input sensor array may include one or more imaging sensor. The input sensor array may include one or more audio transducer. In some implementations, the input sensor array may include a radio-frequency detector. In an illustrative example, the input sensor array may include an ultrasonic audio transducer. In some embodiments, the input sensor array may include image sensing subsystems or modules configurable by the processor 405 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection.

In various implementations, the depicted memory 410 may contain processor executable program instruction modules configurable by the processor 405 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In some embodiments, the input sensor array may include audio sensing subsystems or modules configurable by the processor 405 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In various implementations, the depicted memory 410 may contain processor executable program instruction modules configurable by the processor 405 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In the depicted embodiment, the processor 405 is communicatively and operably coupled with the multimedia interface 435. In the illustrated embodiment, the multimedia interface 435 includes interfaces adapted to input and output of audio, video, and image data. In some embodiments, the multimedia interface 435 may include one or more still image camera or video camera. In various designs, the multimedia interface 435 may include one or more microphone. In some implementations, the multimedia interface 435 may include a wireless communication means configured to operably and communicatively couple the multimedia interface 435 with a multimedia data source or sink external to the mobile device 110. In various designs, the multimedia interface 435 may include interfaces adapted to send, receive, or process encoded audio or video. In various embodiments, the multimedia interface 435 may include one or more video, image, or audio encoder.

In various designs, the multimedia interface 435 may include one or more video, image, or audio decoder. In various implementations, the multimedia interface 435 may include interfaces adapted to send, receive, or process one or more multimedia stream. In various implementations, the multimedia interface 435 may include a GPU. In some embodiments, the multimedia interface 435 may be omitted. Useful examples of the illustrated mobile device 110 include, but are not limited to, personal computers, servers, tablet PCs, smartphones, or other computing devices. In some embodiments, multiple mobile devices 110 may be operably linked to form a computer network in a manner as to distribute and share one or more resources, such as clustered computing devices and server banks/farms. Various examples of such general-purpose multi-unit computer networks suitable for embodiments of the disclosure, their typical configuration and many standardized communication links are well known to one skilled in the art, as explained in more detail in the foregoing FIG. 2 description. In some embodiments, an exemplary mobile device 110 design may be realized in a distributed implementation. In an illustrative example, some mobile device 110 designs may be partitioned between a client device, such as, for example, a phone, and, a more powerful server system, such as server 203, depicted in FIG. 2. In various designs, a mobile device 110 partition hosted on a PC or mobile device may choose to delegate some parts of computation, such as, for example, machine learning or deep learning, to a mobile device 110 host server. In some embodiments, a client mobile device 110 partition may delegate computation-intensive tasks to a mobile device 110 host server to take advantage of a more powerful processor, or to offload excess work.

In an illustrative example, the mobile device is configured with a mobile chip including an engine adapted to implement specialized processing, such as neural networks, machine learning, artificial intelligence, image recognition, audio processing, or digital signal processing. Such an engine adapted to specialized processing has sufficient processing power to implement some mobile device 110 features.

In some alternative embodiments, an exemplary mobile device 110 may be configured to operate on device with less processing power, such as, for example, various gaming consoles or phones, which may not have sufficient processor power, or a suitable CPU architecture, to adequately support mobile device 110. Various embodiment mobile device 110 designs configured to operate on a such a device with reduced processor power may work in conjunction with a more powerful mobile device 110 server system.

Figure 5:
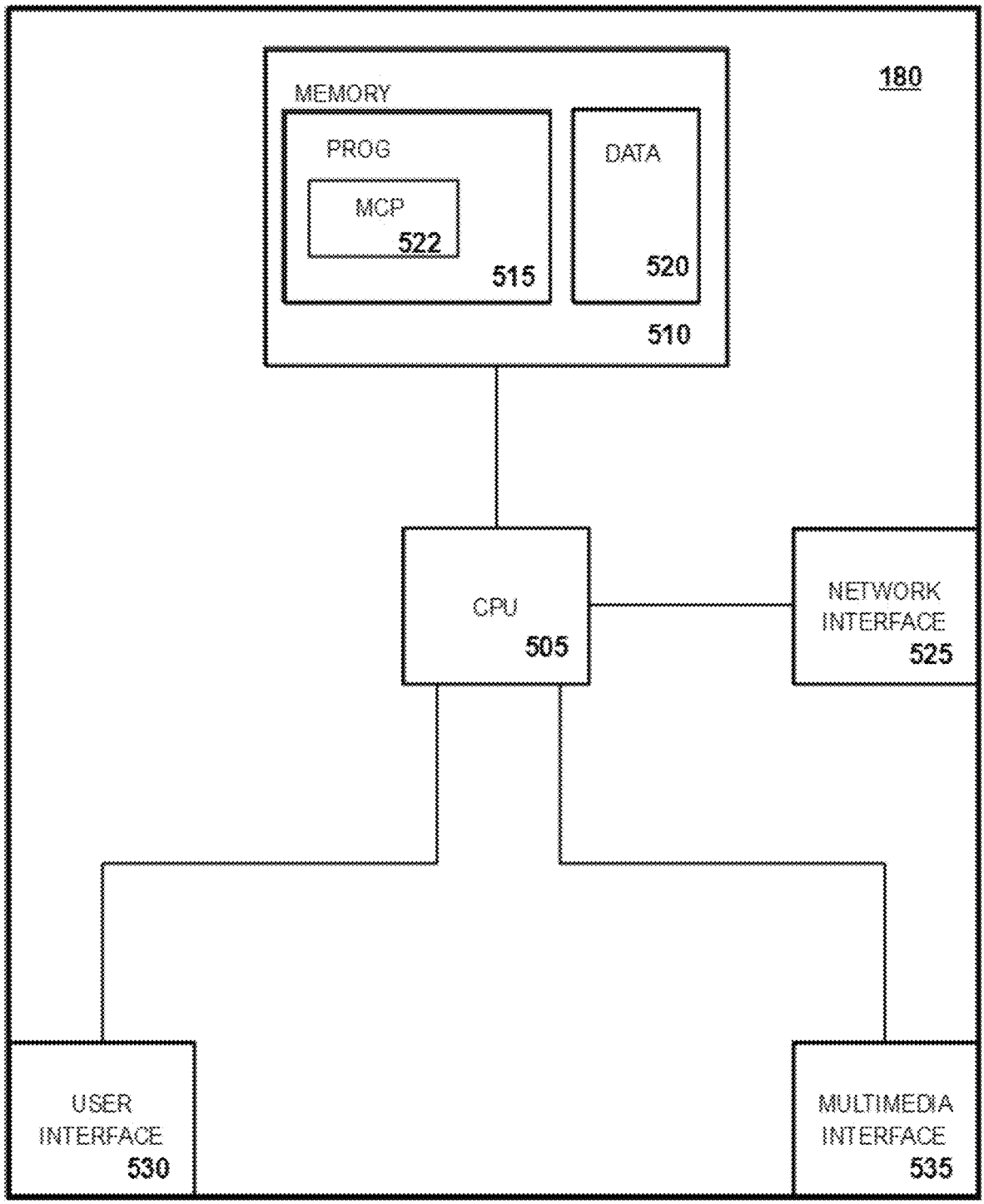
FIG. 5 depicts a structural view of an exemplary monitor device adapted to present image and audio data of a monitored child captured by an exemplary child monitoring device.

FIG. 5 depicts a structural view of an exemplary monitor device adapted to present image and audio data of a monitored child captured by an exemplary child monitoring device. In FIG. 5, the block diagram of the exemplary monitor device 180 includes processor 505 and memory 510. The processor 505 is in electrical communication with the memory 510. The depicted memory 510 includes program memory 515 and data memory 520. The depicted program memory 515 includes processor-executable program instructions implementing the MCP (Monitor Control Program) 522. In some embodiments, the illustrated program memory 515 may include processor-executable program instructions configured to implement an OS (Operating System). In various embodiments, the OS may include processor executable program instructions configured to implement various operations when executed by the processor 505. In some embodiments, the OS may be omitted.

In some embodiments, the illustrated program memory 515 includes processor-executable program instructions configured to implement various Application Software. The Application Software includes processor-executable program instructions configured to implement various operations when executed by the processor 505. The Application Software may also be omitted. In the depicted embodiment, the processor 505 is communicatively and operably coupled with the network interface 525. In various implementations, the network interface may be a wireless network interface. In some designs, the network interface may be a Wi-Fi interface. In some embodiments, the network interface may be a Bluetooth interface. In an illustrative example, the monitor device 180 may include more than one network interface. In some designs, the network interface may be a wireline interface. In some designs, the network interface may be omitted. In the depicted embodiment, the processor 505 is communicatively and operably coupled with the user interface 530. In various implementations, the user interface 530 may be adapted to receive input from a user or send output to a user. In some embodiments, the user interface 530 may be adapted to an input-only or output-only user interface mode.

In various implementations, the user interface 530 may include an imaging display. In some embodiments, the user interface 530 may include an audio interface. In some designs, the audio interface may include an audio input. In various designs, the audio interface may include an audio output. In some implementations, the user interface 530 may be touch-sensitive. In some designs, the monitor device 180 may include an accelerometer operably coupled with the processor 505. In various embodiments, the monitor device 180 may include a GPS module operably coupled with the processor 505. In an illustrative example, the monitor device 180 may include a magnetometer operably coupled with the processor 505. In some embodiments, some or all parts of an exemplary monitor device 180 system may be included within a client device, such that the functionalities could operate in a distributed manner.

In some embodiments, the user interface 530 may include an input sensor array. In various implementations, the input sensor array may include one or more imaging sensor. In various designs, the input sensor array may include one or more audio transducer. In some implementations, the input sensor array may include a radio-frequency detector. In an illustrative example, the input sensor array may include an ultrasonic audio transducer. In some embodiments, the input sensor array may include image sensing subsystems or modules configurable by the processor 505 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In various implementations, the depicted memory 510 may contain processor executable program instruction modules configurable by the processor 505 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In some embodiments, the input sensor array may include audio sensing subsystems or modules configurable by the processor 505 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection.

In various implementations, the depicted memory 510 contains processor-executable program instruction modules configurable by the processor 505 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In the depicted embodiment, the processor 505 is communicatively and operably coupled with the multimedia interface 535. In the illustrated embodiment, the multimedia interface 535 includes interfaces adapted to input and output of audio, video, and image data. In some embodiments, the multimedia interface 535 may include one or more still image camera or video camera. In various designs, the multimedia interface 535 may include one or more microphone. In some implementations, the multimedia interface 535 may include a wireless communication means configured to operably and communicatively couple the multimedia interface 535 with a multimedia data source or sink external to the monitor device 180.

In various designs, the multimedia interface 535 includes interfaces adapted to send, receive, or process encoded audio or video. In various embodiments, the multimedia interface 535 includes one or more video, image, or audio encoder. In various designs, the multimedia interface 535 includes one or more video, image, or audio decoder. In various implementations, the multimedia interface 535 includes interfaces adapted to send, receive, or process one or more multimedia stream. In various implementations, the multimedia interface 535 may include a GPU. In some embodiments, the multimedia interface 535 may be omitted.

Useful examples of the illustrated monitor device 180 are personal computers, servers, tablet PCs, smartphones, or other computing devices. In some embodiments, multiple monitor devices 180 may be operably linked to form a computer network in a manner as to distribute and share one or more resources, such as clustered computing devices and server banks/farms. Various examples of such general-purpose multi-unit computer networks suitable for embodiments of the disclosure, their typical configuration and many standardized communication links are well known to one skilled in the art, as explained in more detail in the foregoing FIG. 2 description.

In some embodiments, an exemplary monitor device 180 design may be realized in a distributed implementation. In an illustrative example, some monitor device 180 designs may be partitioned between a client device, such as, for example, a phone, and, a more powerful server system, such as server 203, depicted in FIG. 2. In various designs, a monitor device 180 partition hosted on a PC or mobile device may choose to delegate some parts of computation, such as, for example, machine learning or deep learning, to a monitor device 180 host server. In some embodiments, a client monitor device 180 partition may delegate computation-intensive tasks to a monitor device 180 host server to take advantage of a more powerful processor, or to offload excess work.

In an illustrative example, some mobile devices may be configured with a mobile chip including an engine adapted to implement specialized processing, such as, for example, neural networks, machine learning, artificial intelligence, image recognition, audio processing, or digital signal processing. In some embodiments, such an engine adapted to specialized processing may have sufficient processing power to implement some monitor device 180 features. However, in some embodiments, an exemplary monitor device 180 may be configured to operate on device with less processing power, such as, for example, various gaming consoles or phones, which may not have sufficient processor power, or a suitable CPU architecture, to adequately support monitor device 180. Various embodiment monitor device 180 designs configured to operate on a such a device with reduced processor power may work in conjunction with a more powerful monitor device 180 server system.

Figure 6:
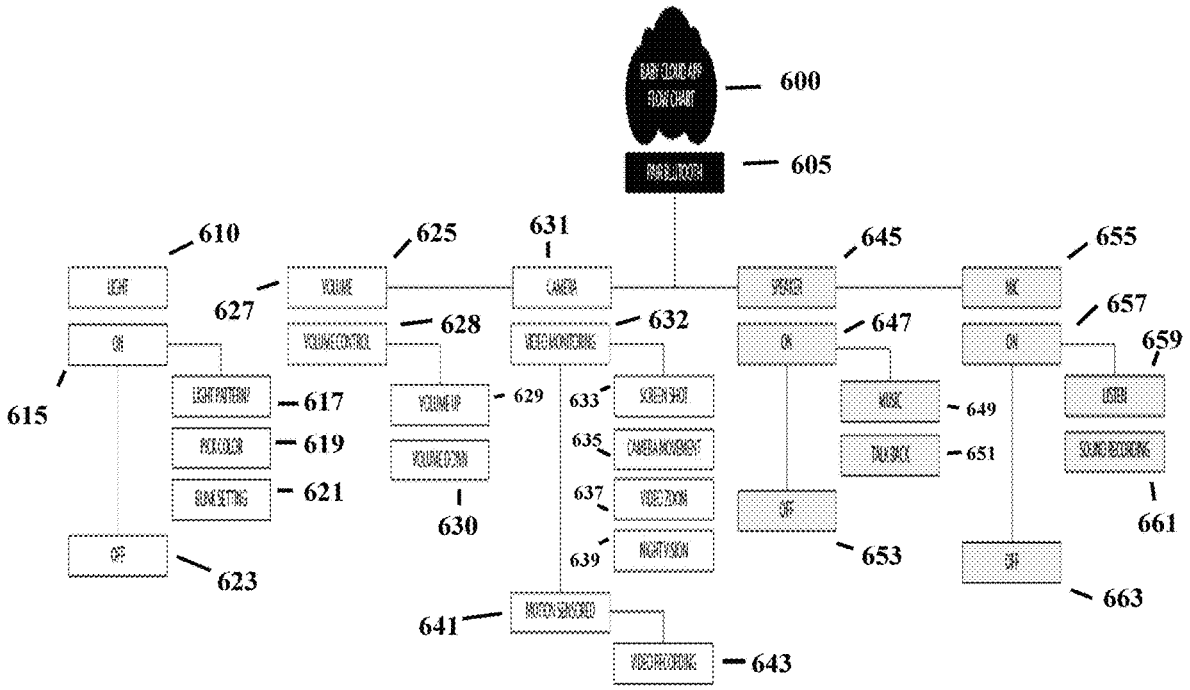
FIG. 6 depicts an illustrative process flow of an exemplary child monitor apparatus configured to monitor a child based on image and audio data captured at a monitored location.

FIG. 6 depicts an illustrative process flow of an exemplary child monitor apparatus configured to monitor a child based on image and audio data captured at a monitored location. Some of the process steps illustrated by FIG. 6 are given from the perspective of an exemplary SMEME (Safety Monitoring and Entertainment Management Engine) 325 executing as program instructions on the child monitor 120 processor 305, depicted in FIG. 3. Some of the processing steps illustrated by FIG. 6 are given from the perspective of an exemplary mobile app 115 executing as program instructions on the mobile device 110 processor 405, depicted in FIG. 4. In some embodiments, various process steps illustrated by FIG. 6 may also be given from the perspective of an exemplary MCP (Monitor Control Program) 522 executing as program instructions on the monitor device 180 processor 505, depicted in FIG. 5. In some embodiments, any or all of the SMEME 325, the mobile app 115, or the MCP 522, may execute as one or more cloud services communicatively coupled with system services, hardware resources, or software elements local to and/or external to any of the depicted devices.

The depicted exemplary method 600 of FIG. 6 begins at step 605 with the mobile device 110 processor 405 displaying menu options to pair Bluetooth devices. The processor 405 pairs the mobile device 110 with the child monitor device 120 via Bluetooth. At step 610 the mobile device 110 processor 405 then displays light control 610 menu options. The mobile device 110 processor 405 displays options to turn lights on 615, select a light pattern 617, pick a light color 619, activate a blink setting 621, or turn lights off 623. The mobile device 110 processor 405 communicates with the child monitor device 120 processor 305 to turn lights on 615, activate the selected light pattern 617, illuminate the chosen light color 619, or activate the blink setting 621, or turn lights off 623. The method continues at step 625 with the mobile device 110 processor 405 displaying volume 625 menu options.

The mobile device 110 processor 405 displays options for volume control 628 including volume up 629 and volume down 630. The mobile device 110 processor 405 communicate with the child monitor device 120 processor 305 to activate the volume control 628 in the child monitor device 120 including adjusting the volume up 629 and volume down 630.

The method continues at step 631 with the mobile device 110 processor 405 displaying camera menu options 631. The mobile device 110 processor 405 displays camera options to activate video monitoring 632, capture a screen shot 633, move camera 635, zoom video 637, activate night vision 639, activate motion sensing 641, or record video 643.

In some embodiments, the mobile device 110 processor 405 may communicate with the child monitor device 120 processor 305 to operate the video monitoring 632, capture a screen shot 633, move camera 635, zoom video 637, activate night vision 639, activate motion sensing 641, or record video 643. The method continues at step 645 with the mobile device 110 processor 405 displaying speaker options 645 including speaker on 647, music 649, talk back 651, and speaker off 653. In various embodiments, the mobile device 110 processor 405 may communicate with the child monitor device 120 processor 305 to turn the speaker on 647, select music 649, activate talk back 651, and turn the speaker off 653.

The method continues at step 655 with the mobile device 110 processor 405 displaying microphone options 655 including microphone on 657, listen 659, sound recording 661, and microphone off 663. In some embodiments, the mobile device 110 processor 405 may communicate with the child monitor device 120 processor 305 to turn the microphone on 657, listen 659, activate sound recording 661, and turn the microphone off 663.

Figure 7:
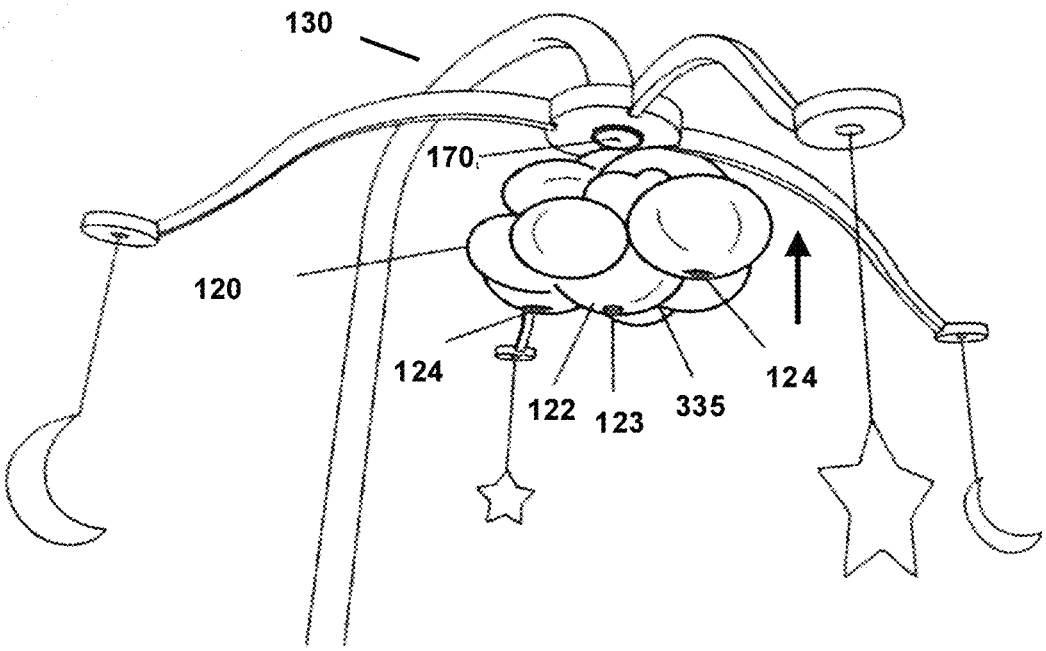
FIG. 7 depicts an illustrative side perspective exploded view of an exemplary child monitor device embodiment design in an exemplary assembly configuration.

FIG. 7 depicts an illustrative side perspective exploded view of an exemplary child monitor device embodiment design in an exemplary assembly configuration. In FIG. 7, the exemplary child monitor device 120 includes microphone 122, camera 123, speaker 124, and multimedia interface 335. In the depicted embodiment, the multimedia interface 335 includes a Bluetooth interface. In the illustrated embodiment, the connector 170 is being engaged to removably secure the child monitor device 120 to the stand 130.

Figure 8:
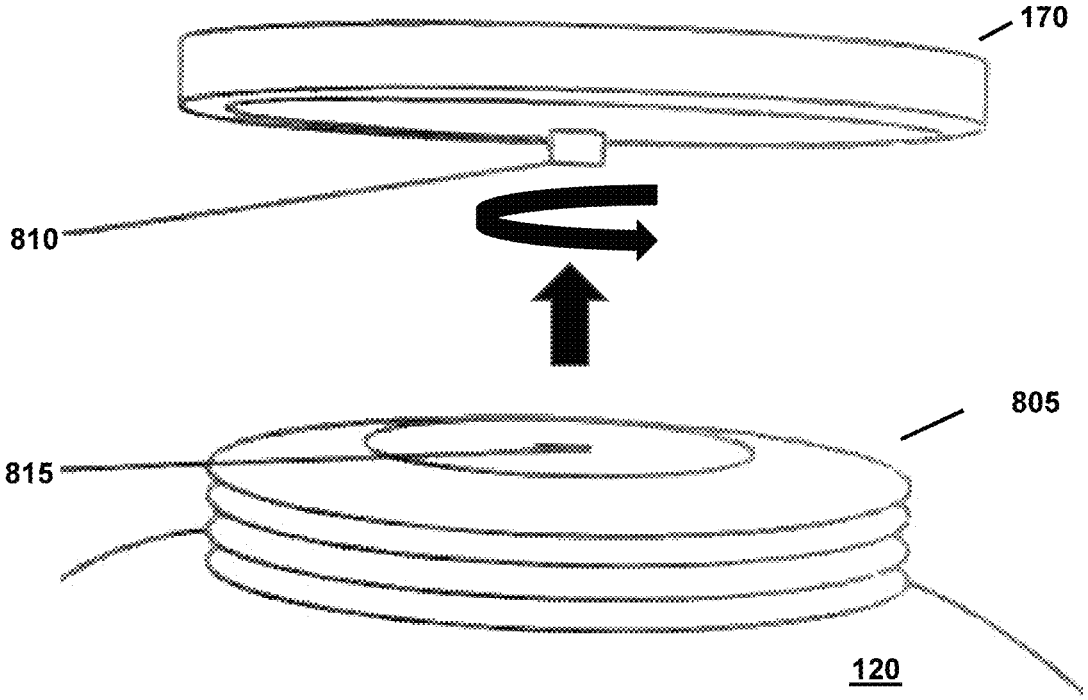
FIG. 8 depicts an illustrative partial side perspective view of an exemplary child monitor device embodiment connector design in an exemplary assembly mode.

FIG. 8 depicts an illustrative partial side perspective view of an exemplary child monitor device embodiment connector design in an exemplary assembly mode. In FIG. 8, the exemplary child monitor device 120 includes the mount coupling 805 configured with the female rapid charging USB port 815. In the depicted example, the mount coupling 805 is being engaged with the connector 170 to removably secure the child monitor device 120. In the illustrated embodiment, the connector 170 includes the male rapid charging USB port 810.

Figures 9A, 9B, 9C:
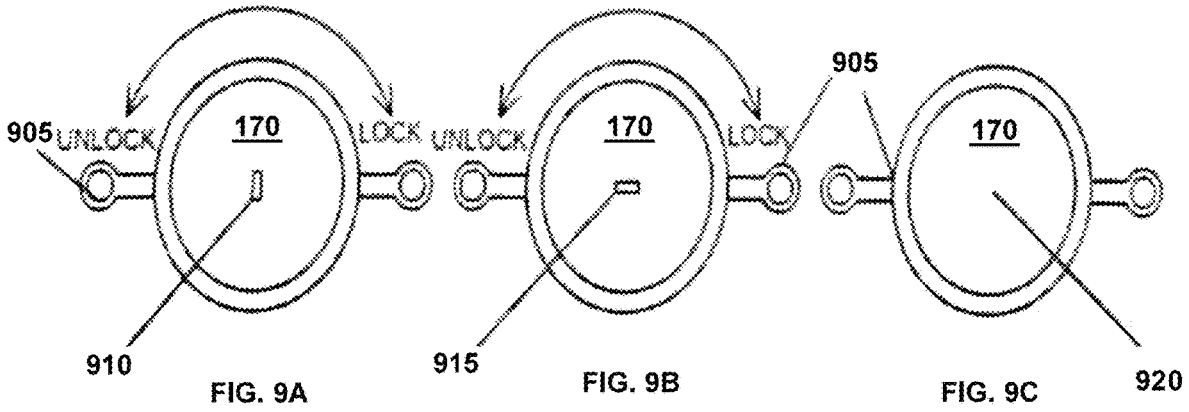
FIGS. 9A-9C depict various illustrative interior front views of exemplary child monitor device embodiment connector designs in exemplary operating modes.

FIGS. 9A-9C depict various illustrative interior front views of exemplary child monitor device embodiment connector designs in exemplary operating modes. In FIG. 9A, the exemplary wall mount connection port 905 includes connector 170 depicted in an illustrative locked and powered mode 910. In FIG. 9B, the exemplary wall mount connection port 905 includes connector 170 depicted in an illustrative unlocked and powered mode 915. In FIG. 9C, the exemplary wall mount connection port 905 includes connector 170 depicted in an illustrative unpowered mode 920.

Figure 10:
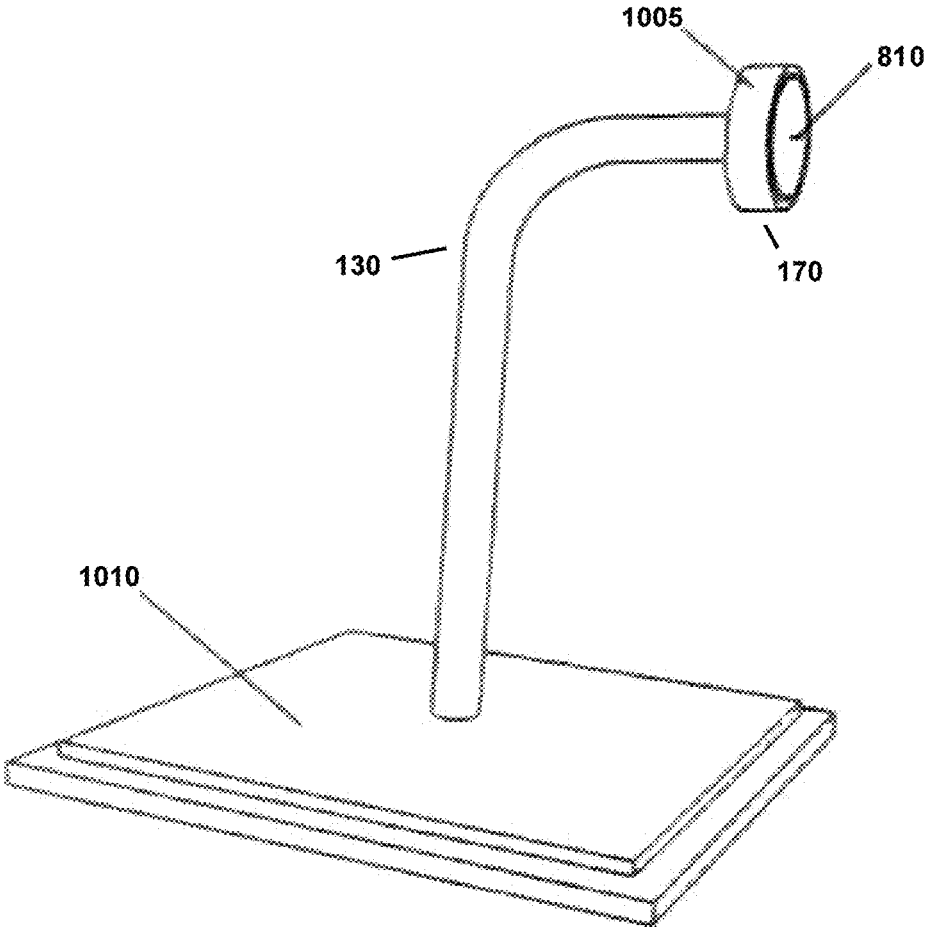
FIG. 10 depicts an illustrative side perspective view of an exemplary child monitor device support structure.

FIG. 10 depicts an illustrative side perspective view of an exemplary child monitor device support structure. In FIG. 10, the connection port 1005 is coupled with the stand 130 supporting the connector 170 configured with the male rapid charging USB port 810. In the depicted embodiment, the stand 130 is supported by the cloud stand 1010.

Figure 11:
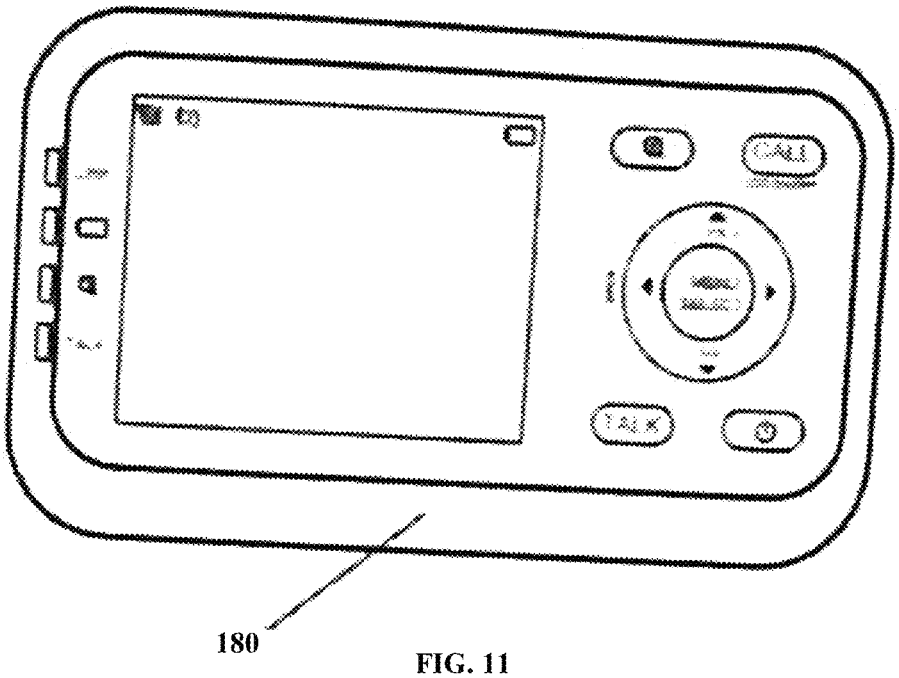
FIG. 11 depicts an illustrative front perspective view of an exemplary child monitor apparatus monitor device adapted to present image and audio data of a monitored child.

FIG. 11 depicts an illustrative front perspective view of an exemplary child monitor apparatus monitor device adapted to present image and audio data of a monitored child. In FIG. 11, the monitor device 180, also depicted in FIG. 5, includes a touch screen, video interface, and user controls.

Figure 12:
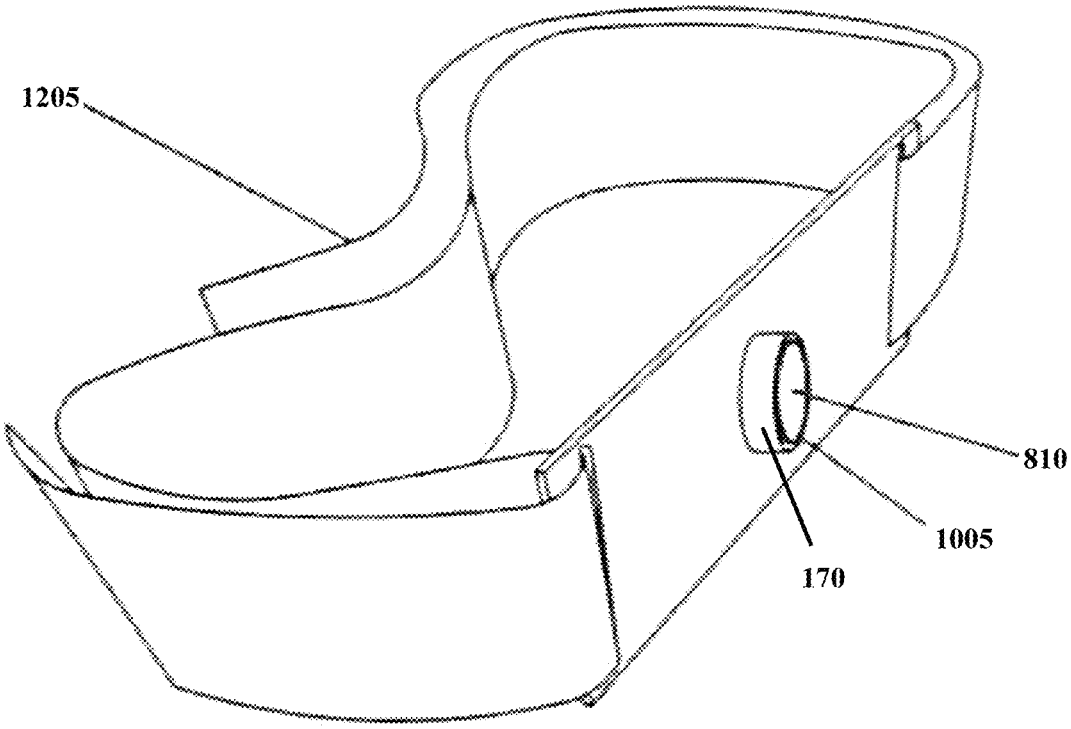
FIG. 12 depicts an illustrative perspective view of an exemplary child monitor apparatus strap mount embodiment design.

FIG. 12 depicts an illustrative perspective view of an exemplary child monitor apparatus strap mount embodiment design. In FIG. 12, the exemplary car seat/head rest hook-and-loop strap mount 1205 includes the connection port 1005 configured with connector 170 including the male rapid charging USB port 810.

Figure 13:
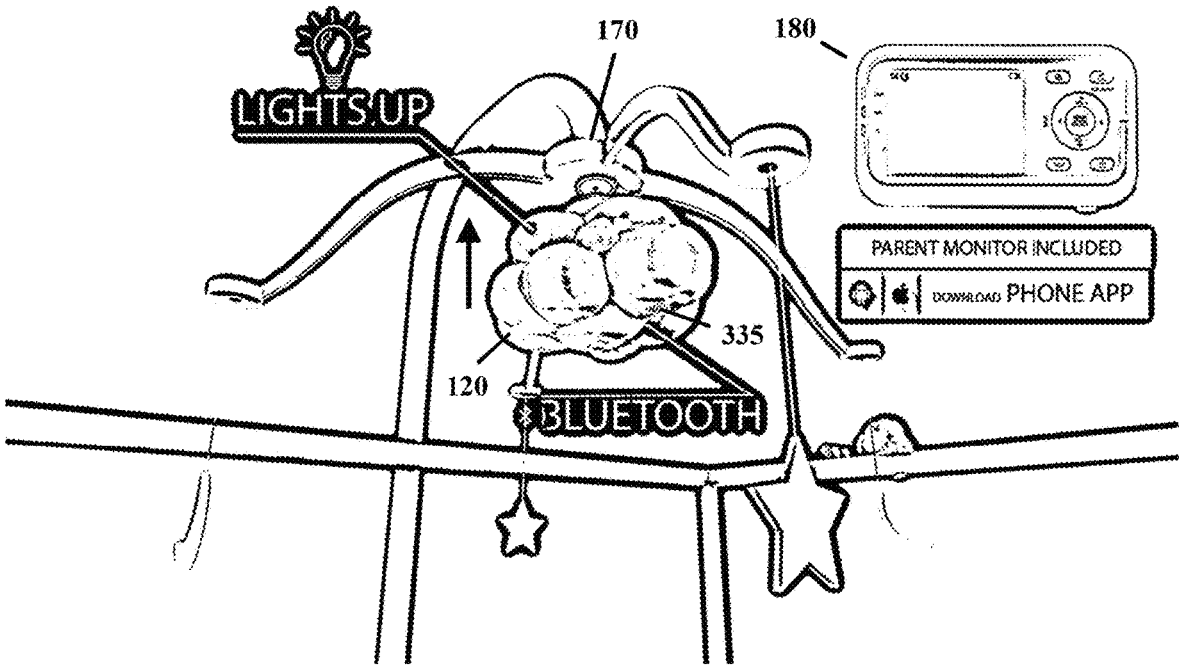
FIG. 13 depicts an illustrative exploded side perspective view of an exemplary child monitor apparatus embodiment design in an exemplary assembly configuration.

FIG. 13 depicts an illustrative exploded side perspective view of an exemplary child monitor apparatus embodiment design in an exemplary assembly configuration. In the depicted embodiment, the child monitor device 120 is illustrated engaging with the connector 170 to secure the child monitor device 120 in an operational configuration. In the illustrated embodiment, the child monitor device 120 includes the Bluetooth interface 335 to communicatively link the child monitor device 120 with the monitor device 190.

Figure 14:
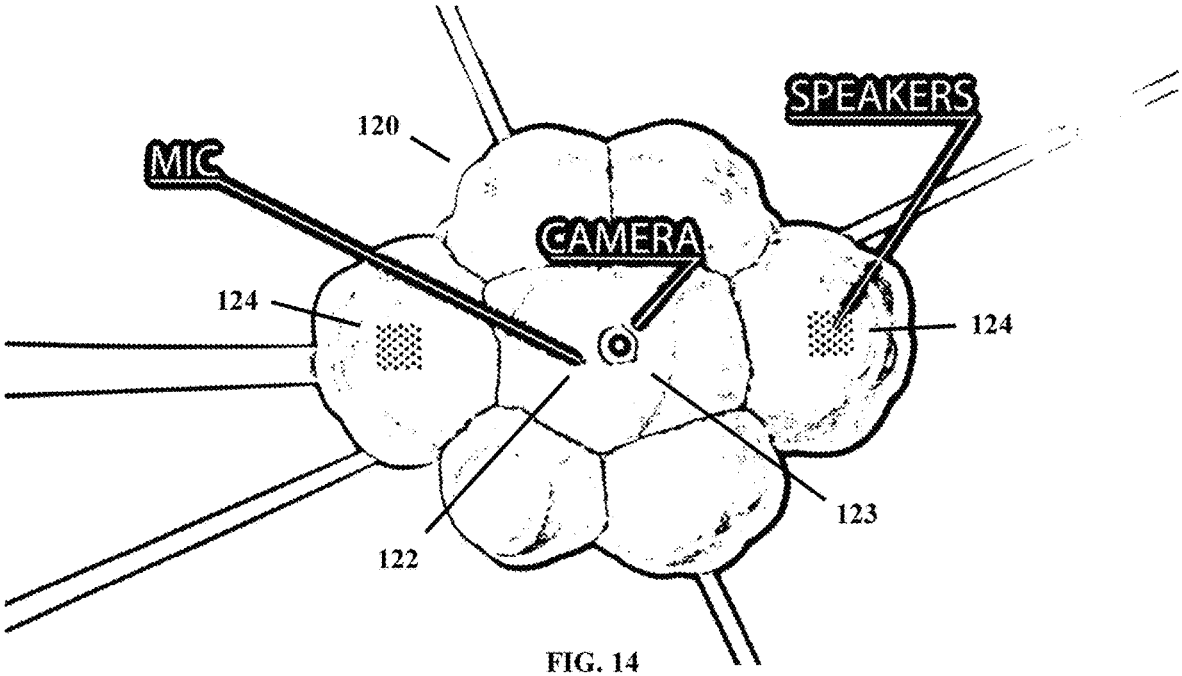
FIG. 14 depicts an illustrative front view of an exemplary child monitor device embodiment design in an exemplary operational configuration.

FIG. 14 depicts an illustrative front view of an exemplary child monitor device embodiment design in an exemplary operational configuration. In the illustrated embodiment, the child monitor device 120 includes the microphone 122, the camera 123, and the audio speakers 124.

Figure 15:
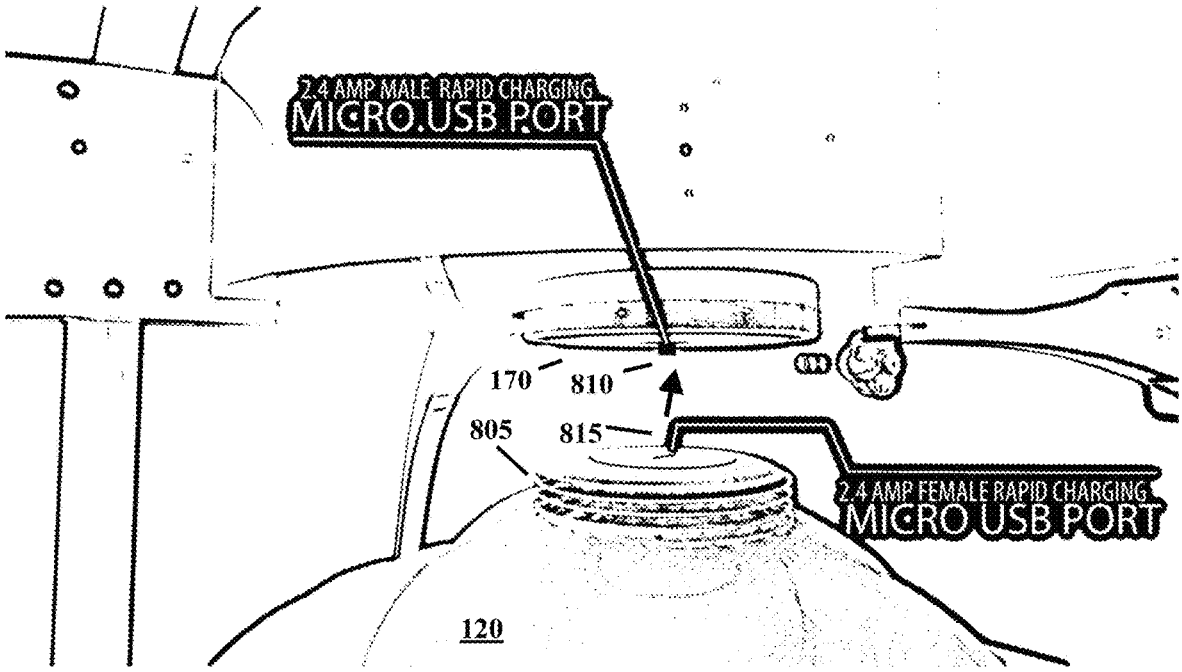
FIG. 15 depicts an illustrative side exploded view of an exemplary child monitor device coupling with an embodiment connector in an exemplary assembly mode.

FIG. 15 depicts an illustrative side exploded view of an exemplary child monitor device coupling with an embodiment connector in an exemplary assembly mode. In the depicted embodiment, the child monitor device 120 is illustrated engaging with the connector 170 to secure the child monitor device 120 in an operational configuration. In the illustrated embodiment, the child monitor device 120 includes the mount coupling 805 configured with the female rapid charging USB port 815. In the depicted example, the mount coupling 805 is being engaged with the connector 170 to removably secure the child monitor device 120. In the illustrated embodiment, the connector 170 includes the male rapid charging USB port 810.

Figure 16:
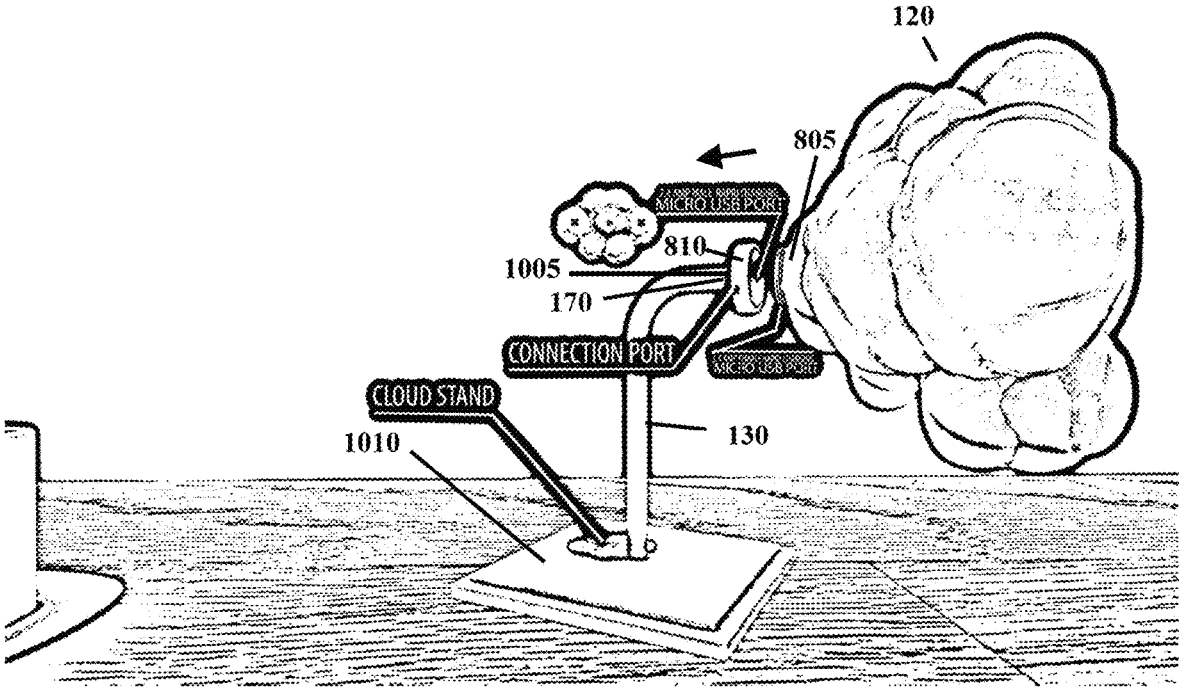
FIG. 16 depicts an illustrative side perspective exploded view of an exemplary child monitor apparatus embodiment design configured with an embodiment support structure in an exemplary assembly mode.

FIG. 16 depicts an illustrative side perspective exploded view of an exemplary child monitor apparatus embodiment design configured with an embodiment support structure in an exemplary assembly mode. In the illustrated embodiment, the child monitor device 120 is illustrated engaging with the connector 170 to removably couple the child monitor device 120 with the stand 130 which is supported by the cloud stand 1010. In the depicted embodiment, the connection port 1005 is coupled with the stand 130 supporting the connector 170 configured with the male rapid charging USB port 810. In the depicted example, the child monitor device 120 mount coupling 805 is being engaged with the connector 170 to removably secure the child monitor device 120.

Figure 17:
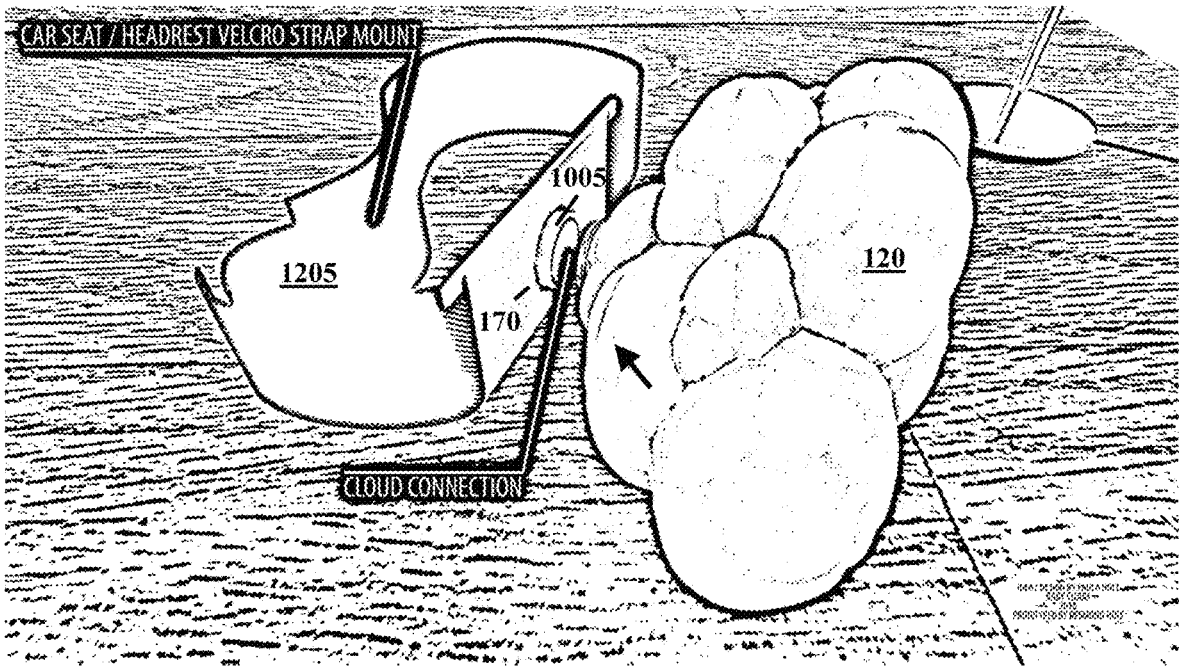
FIG. 17 depicts an illustrative side perspective exploded view of an exemplary child monitor device design configured with an embodiment strap mount design in an exemplary assembly mode.

FIG. 17 depicts an illustrative side perspective exploded view of an exemplary child monitor device design configured with an embodiment strap mount design in an exemplary assembly mode. In the illustrated embodiment, the child monitor device 120 is depicted engaging with the connector 170 to removably couple the child monitor device 120 with the car seat/head rest hook-and-loop strap mount 1205 via the connection port 1005.

Figure 18:
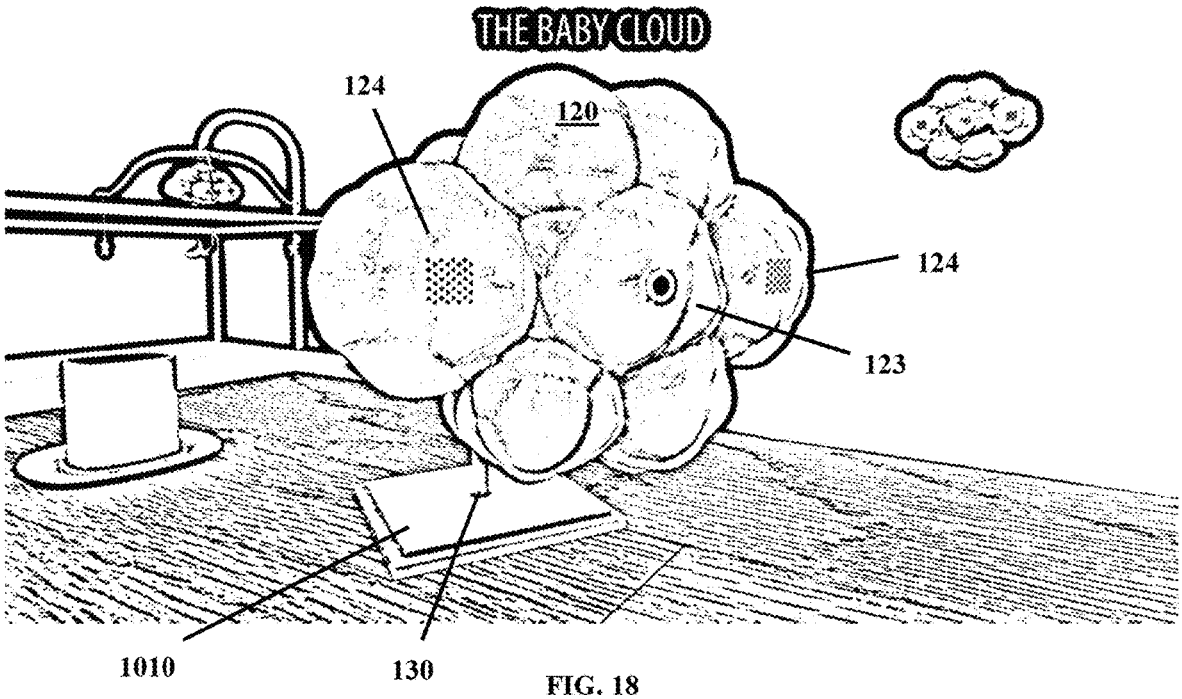
FIG. 18 depicts an illustrative front perspective view of an exemplary child monitor apparatus embodiment design configured with an embodiment support structure in an exemplary operational mode.

FIG. 18 depicts an illustrative front perspective view of an exemplary child monitor apparatus embodiment design configured with an embodiment support structure in an exemplary operational mode. In the depicted embodiment, the child monitor device 120 is depicted in an exemplary operational mode supported by the stand 130 coupled with the cloud stand 1010. In the illustrated embodiment, the exemplary child monitor device 120 includes the camera 123 and the audio speakers 124.

Figure 19:
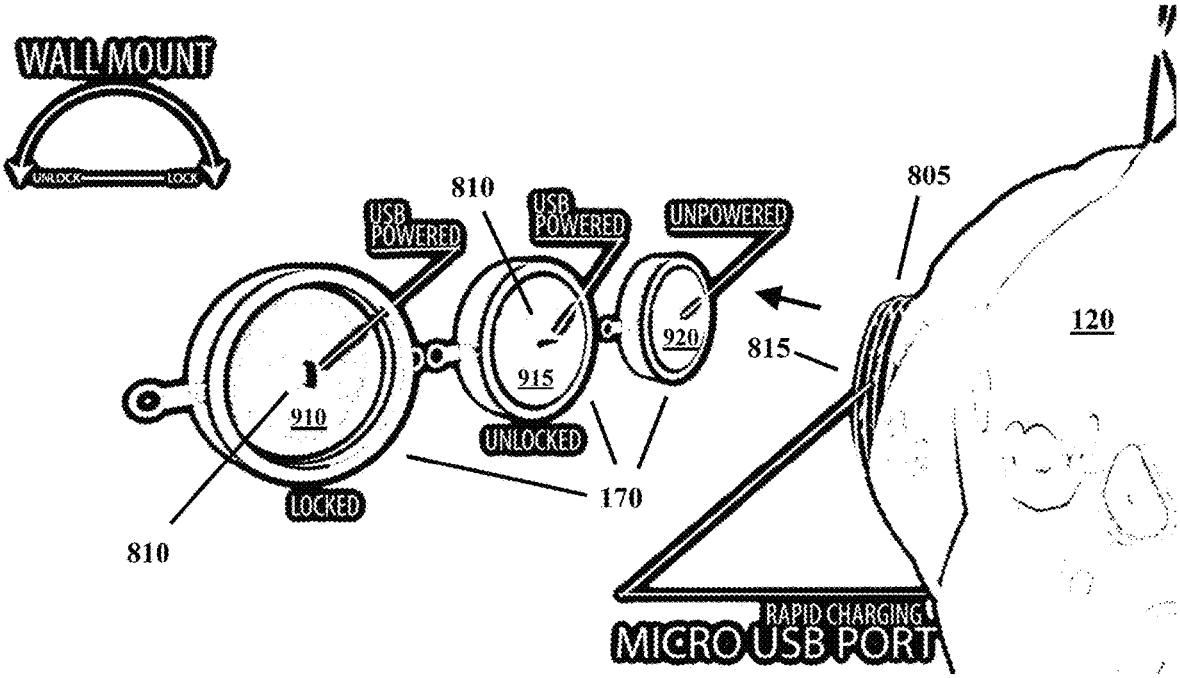
FIG. 19 depicts an illustrative perspective view of an exemplary child monitor device embodiment connector design coupling with an exemplary child monitor device in various exemplary assembly modes.

FIG. 19 depicts an illustrative perspective view of an exemplary child monitor device embodiment connector design coupling with an exemplary child monitor device in various exemplary assembly modes. In the illustrated embodiment, the child monitor device 120 is depicted engaging via the mount coupling 805, the male rapid charging USB port 810, and the female rapid charging USB port 815 with wall mount connection ports in various available connection modes. In one example, the child monitor device 120 may engage with a wall mount connection port in the locked and powered mode 910. In another example, the child monitor device 120 may engage with a wall mount connection port in the unlocked and powered mode 915. In another example, the child monitor device 120 may engage with a wall mount connection port in the unpowered mode 920. Together, this embodiment comprises the key features of the wall mounted locking unit, and is particularly useful as it allows the caregiver to quickly and easily remove the child monitor device 120 from a first location having a first connection requirement (for example, unlocked and powered mode 915), and reinstall the child monitor device 120 at a second location having a second connection requirement (for example, unpowered mode 920)

Although various embodiments have been described with reference to the Figures, other embodiments are possible.

For example, various embodiments may relate to a cloud-shaped baby monitoring system which starts out as a crib mobile. In some embodiments, the system may be placed outside the crib and simply used for monitoring purposes. In various designs, the system may include various means to mount and support the system for additional monitoring outside the crib and in other rooms or even a motor vehicle.

In various exemplary scenarios, an embodiment child monitor apparatus may be referred to as a Baby Cloud. In some embodiments, an exemplary child monitor apparatus may be detachable. In various embodiment implementations, an illustrative Baby Cloud design may include a camera. In some embodiments, an exemplary Baby Cloud implementation may include automated virtual assistant functionality such as, for example, Amazon's Alexa.

In some illustrative scenarios exemplary of various embodiments' usage, an exemplary Baby Cloud design may normally rest on a mobile above a baby's crib, but the parents can detach the Baby Cloud and clip it to a stroller, or anywhere, using an embodiment Baby Cloud universal connector.

In various embodiment implementations, an exemplary Baby Cloud design may watch a child, allow a parent or caregiver to talk to the child, and play music to the child.

In some embodiments, an exemplary Baby Cloud implementation may be configured by a user from modular components. In some embodiment Baby Cloud implementations, a modular Baby Cloud design may be disconnected while monitoring a child at a first location and moved with the child to monitor the child at second location, based on the portability permitted by the universal Baby Cloud connector configured in the first and second locations.

In various embodiments, an exemplary Baby Cloud design may consist of a monitoring device cloud, one or more audio speaker, a microphone, and, a camera. In some scenarios, an embodiment Baby Cloud apparatus may be useful to monitor infants while providing adaptability for use in and outside of a crib. For some individuals with children, baby monitors are needed to monitor children as they sleep, play, and ride in the car.

In various scenarios exemplary of prior art baby monitors, various crib monitors for infants exist, however there is a lack of monitors that can be transitioned from the crib to other locations as the child grows. Ingenious and practical, various Baby Cloud embodiment designs may include a cloud-shaped baby monitoring system that can start out as a crib mobile, and then be placed outside the crib as the child grows.

Some embodiment Baby Cloud implementations may include a camera, microphone, and speakers. In various embodiment designs, an exemplary Baby Cloud's camera may rotate substantially 180 degrees and feature night vision, motion sensor activation, and zoom capabilities. In an illustrative example, some embodiment Baby Cloud designs may permit parents to watch a child from different angles, record audio/video, as well as take screenshot photos for viewing at a later time.

In some scenarios illustrative of various Baby Cloud embodiments' usage, an embodiment Baby Cloud may begin as a mobile, but can be transitioned from a mobile over a crib into a stand, or wall mount, as the child grows or moves from location to location.

In various embodiments, an exemplary Baby Cloud design may be mounted onto vehicle seats, permitting users to view their baby in the car while in transit. In an illustrative example, an embodiment Baby Cloud may be configured to permit monitoring by a parent in a front-facing vehicle seat of a child secured in rear-facing child safety seat installed in a vehicle rear seat.

In an illustrative example, the speakers included in various Baby Cloud embodiment designs may be used for music, or to listen to the child. Some embodiment Baby Cloud implementations include a Bluetooth feature permitting users to play their choice of music. In some illustrative scenarios, various Baby Cloud embodiment implementations may be integrated with a mobile app configured, for example, to permit users to change the music, and have video monitor access from their phones. In various embodiment designs, an exemplary Baby Cloud mobile app may connect to an embodiment Baby Cloud monitor via Bluetooth or WiFi. In some examples, an embodiment Baby Cloud implementation may include a rechargeable battery. In some designs, an embodiment Baby Cloud implementation may include remotely controllable lights.

In some illustrative scenarios, various Baby Cloud embodiments may be the only product of its kind designed to transition for use outside of the crib as the child grows. In an illustrative example, future embodiment modifications may include creating Baby Cloud accessory pieces, such as a headrest mount, table stand, or the like.

In various illustrative scenarios exemplary of some embodiments' usage, the cloud-shaped structure of exemplary Baby Cloud child monitor designs may advantageously help to calm or comfort a monitored child. In various examples, an exemplary cloud-shaped child-monitor structure may advantageously avoid startling or scaring a monitored child. In various examples, an exemplary cloud-shaped child-monitor structure may be advantageously substituted with other structures having varied degrees of similarity to other structures familiar to a child. In an illustrative example, some embodiment child monitor structure designs may incorporate visual aspects of a child's favorite cartoon character.

In the Summary above and in this Detailed Description, and the Claims below, and in the accompanying drawings, reference is made to particular features of various embodiments of the invention. It is to be understood that the disclosure of embodiments of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale and features of one embodiment may be employed with other embodiments as the skilled artisan would recognize, even if not explicitly stated herein. Descriptions of well-known components and processing techniques may be omitted so as to not unnecessarily obscure the embodiments.

In the present disclosure, various features may be described as being optional, for example, through the use of the verb "may;", or, through the use of any of the phrases:

"in some embodiments," "in some implementations," "in some designs," "in various embodiments," "in various implementations,", "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In various embodiments. elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of embodiments of the invention, even those disclosed solely in combination with other features of embodiments of the invention, may be combined in any configuration excepting those readily apparent to the person skilled in the art as nonsensical. Likewise, use of the singular and plural is solely for the sake of illustration and is not to be interpreted as limiting.

In the present disclosure, all embodiments where "comprising" is used may have as alternatives "consisting essentially of," or "consisting of." In the present disclosure, any method or apparatus embodiment may be devoid of one or more process steps or components. In the present disclosure, embodiments employing negative limitations are expressly disclosed and considered a part of this disclosure.

Certain terminology and derivations thereof may be used in the present disclosure for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an embodiment "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f).

According to an embodiment of the present invention, the system and method may be accomplished through the use of one or more computing devices. As depicted, for example, at least in FIG. 1, FIG. 2, and FIG. 3, one of ordinary skill in the art would appreciate that an exemplary system appropriate for use with embodiments in accordance with the present application may generally include one or more of a Central processing Unit (CPU), Random Access Memory (RAM), a storage medium (e.g., hard disk drive, solid state drive, flash memory, cloud storage), an operating system (OS), one or more application software, a display element, one or more communications means, or one or more input/output devices/means. Examples of computing devices usable with embodiments of the present invention include, but are not limited to, proprietary computing devices, personal computers, mobile computing devices, tablet PCs, mini-PCs, servers or any combination thereof. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In various embodiments, communications means, data store(s), processor(s), or memory may interact with other components on the computing device, in order to effect the provisioning and display of various functionalities associated with the system and method detailed herein. One of ordinary skill in the art would appreciate that there are numerous configurations that could be utilized with embodiments of the present invention, and embodiments of the present invention are contemplated for use with any appropriate configuration.

According to an embodiment of the present invention, the communications means of the system may be, for instance, any means for communicating data over one or more networks or to one or more peripheral devices attached to the system. Appropriate communications means may include, but are not limited to, circuitry and control systems for providing wireless connections, wired connections, cellular connections, data port connections, Bluetooth connections, or any combination thereof. One of ordinary skill in the art would appreciate that there are numerous communications means that may be utilized with embodiments of the present invention, and embodiments of the present invention are contemplated for use with any communications means.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description may set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a sequence of computational instructions or program instructions. It will be appreciated that a programmable apparatus (i.e., computing device) can receive such a computer program and, by processing the computational instructions thereof, produce a further technical effect.

A programmable apparatus may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the depicted functions. This particular machine provides a means for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software modules, or as modules that employ external routines, code, services, and so forth, or any combination of these. All such implementations are within the scope of the present disclosure.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. An apparatus, comprising:

a portable baby monitor module, comprising:

a baby monitor device, comprising;

a cloud structure, comprising: a substantially cloud-shaped composition of matter having a cloud structure first side comprising a surface including a plurality of conjoined substantially spherical protrusions; and, having a cloud structure second side substantially opposite the cloud structure first side;

a processor;

a speaker disposed in the cloud structure first side, and operably coupled with the processor;

a microphone disposed in the cloud structure first side, and operably coupled with the processor;

a camera disposed in the cloud structure first side, and operably coupled with the processor;

a substantially circular mounting coupling disposed in the cloud structure second side, configured with a USB power connection, having a groove longitudinally disposed in the surface of the mounting coupling's circumference, and adapted to releasably couple with a connector; and, a memory that is not a transitory propagating signal, the memory connected to the processor and encoding computer readable instructions, including processor executable program instructions, the computer readable instructions accessible to the processor, wherein the processor executable program instructions, when executed by the processor, cause the processor to perform operations comprising:

monitor a child as a function of image and audio data captured at a first location;

provide access at a second location to image and audio data of the child captured at a third location;

configure a cloud-based virtual assistant to trigger alerts based on exceptional child conditions detected as a function of image or audio data captured from the third location; and, automatically send alerts generated in response to exceptional child conditions detected as a function of image and audio data captured at the third location; and, a substantially circular connector, including a USB power connection, the connector engaged with the mounting coupling disposed in the cloud structure second side and releasably securing the baby monitor device to a support structure retaining the connector.

2. The apparatus of claim 1, wherein the operations performed by the processor further comprise rotating the camera substantially 180 degrees.

3. The apparatus of claim 1, wherein the apparatus further comprises a strap adapted with hook-and-loop fastening means to releasably secure the baby monitor device to a vehicle interior structure.

4. The apparatus of claim 1, wherein the apparatus further comprises a stand adapted to retain a connector configured to releasably secure the baby monitor device to the stand when the connector is engaged with the mounting coupling disposed in the cloud structure second side.

5. An apparatus, comprising:

a portable baby monitor module, comprising:

a baby monitor device, comprising;

a cloud structure, comprising: a substantially cloud-shaped composition of matter having a cloud structure first side comprising a surface including a plurality of conjoined substantially spherical protrusions; and, having a cloud structure second side substantially opposite the cloud structure first side;

a processor;

a speaker disposed in the cloud structure first side, and operably coupled with the processor;

a microphone disposed in the cloud structure first side, and operably coupled with the processor;

a camera disposed in the cloud structure first side, and operably coupled with the processor;

a substantially circular mounting coupling disposed in the cloud structure second side, configured with a USB power connection, having a groove longitudinally disposed in the surface of the mounting coupling's circumference, and adapted to releasably couple with a connector; and, a memory that is not a transitory propagating signal, the memory connected to the processor and encoding computer readable instructions, including processor executable program instructions, the computer readable instructions accessible to the processor, wherein the processor executable program instructions, when executed by the processor, cause the processor to perform operations comprising:

communicate with a mobile device application to receive operational commands from the mobile device application and send monitored child video and audio feeds to the mobile device application;

monitor a child as a function of image and audio data captured at a first location;

provide access at a second location to image and audio data of the child captured at a third location;

send monitored child video and audio data captured from the third location to a monitor device at the second location; and, automatically trigger alerts based on exceptional child conditions detected as a function of image or audio data captured from the third location; and, a substantially circular connector, including a USB power connection, the connector engaged with the mounting coupling disposed in the cloud structure second side and releasably securing the baby monitor device to a support structure retaining the connector.

6. The apparatus of claim 5, wherein the operations performed by the processor further comprise playing on the speaker music selected by the mobile device application.

7. The apparatus of claim 5, wherein the operations performed by the processor further comprise playing on the speaker audio transmitted by the mobile device application.

* * * * *